United States Patent [19]

Allen

[11] 4,432,466

[45] Feb. 21, 1984

[54] CONTAINER HAVING CLOSURE PANEL INCLUDING INTEGRALLY FORMED SCOOP RUPTURABLE THEREFROM

[75] Inventor: David O. Allen, Wilmington, Ohio

[73] Assignee: Buckeye Molding Company, New Vienna, Ohio

[21] Appl. No.: 444,545

[22] Filed: Nov. 26, 1982

Related U.S. Application Data

[63] Continuation of Ser. No. 345,344, Feb. 3, 1982, abandoned, which is a continuation of Ser. No. 205,458, Nov. 10, 1980, abandoned.

[51] Int. Cl.[3] ..... B65D 17/40

[52] U.S. Cl. ..... 220/276; 220/270; 220/85 D

[58] Field of Search ..... 220/23, 85 D, 270, 276; 229/1.5 C; 215/100

[56] References Cited

U.S. PATENT DOCUMENTS

| | | | |
|---|---|---|---|
| 3,197,057 | 7/1965 | Weitzner . | |
| 3,334,778 | 8/1967 | Saunders . | |
| 3,487,974 | 1/1970 | Schovee . | |
| 3,550,805 | 12/1970 | Leonforte | 220/42 |
| 3,955,742 | 5/1976 | Marshall et al. . | |
| 4,036,398 | 7/1977 | Hoogvelt et al. . | |
| 4,060,176 | 11/1977 | Tobiasson . | |
| 4,103,803 | 8/1978 | Irvine . | |
| 4,154,109 | 5/1979 | Kelson | 73/429 |
| 4,212,409 | 7/1980 | Jeppson . | |
| 4,267,937 | 5/1981 | Piltz et al. | 220/267 |

*Primary Examiner*—George T. Hall

*Attorney, Agent, or Firm*—Roger S. Dybvig

[57] ABSTRACT

A container includes a molded container blank comprising a tubular wall and an integrally formed closure panel closing one end of the tubular wall. The closure panel may be torn away from the tubular wall and has an integrally formed scoop wall projecting into the region surrounded by the tubular wall. The panel has an endless scoreline surrounding the scoop wall and merging with another scoreline, both scorelines being rupturable to allow removal from the closure panel of a scoop including the scoop wall and a scoop handle and scoop base derived from the closure panel. The panel and its container to the tubular wall so formed that the scoop may be removed from other portions of the closure panel when the panel is removed from the tubular wall to open the container.

10 Claims, 10 Drawing Figures

FIG-1
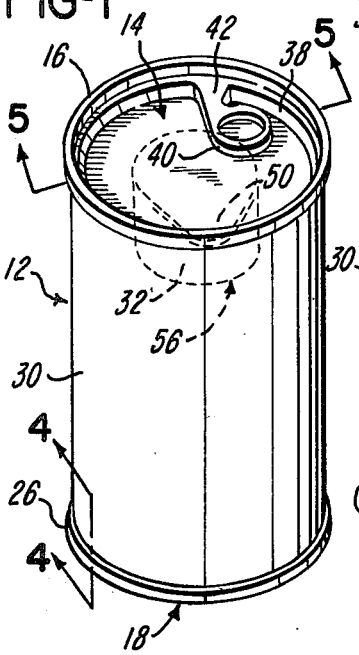
FIG-2
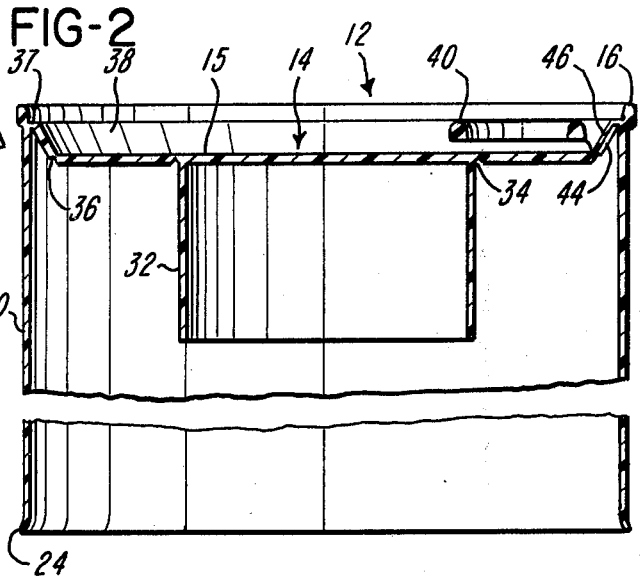
FIG-3
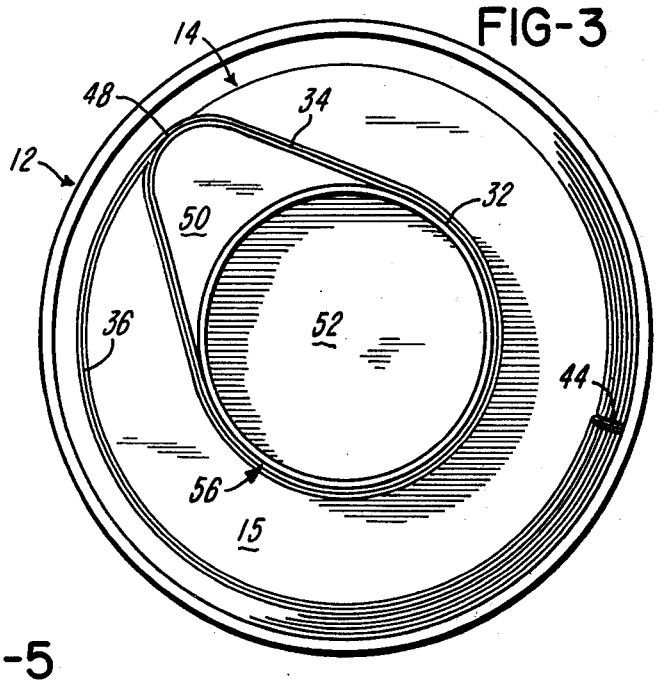
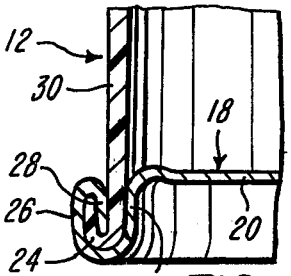
FIG-4
FIG-5
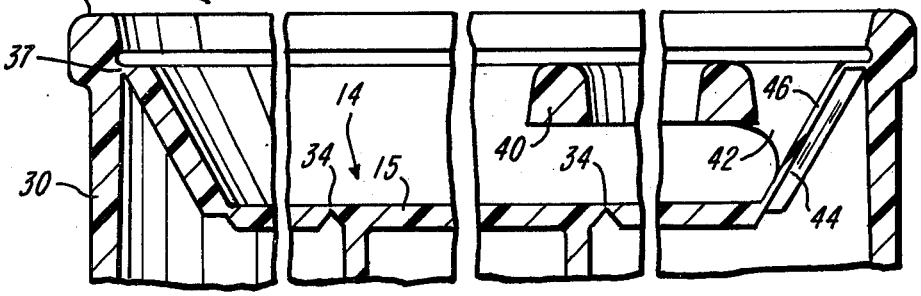

FIG-6
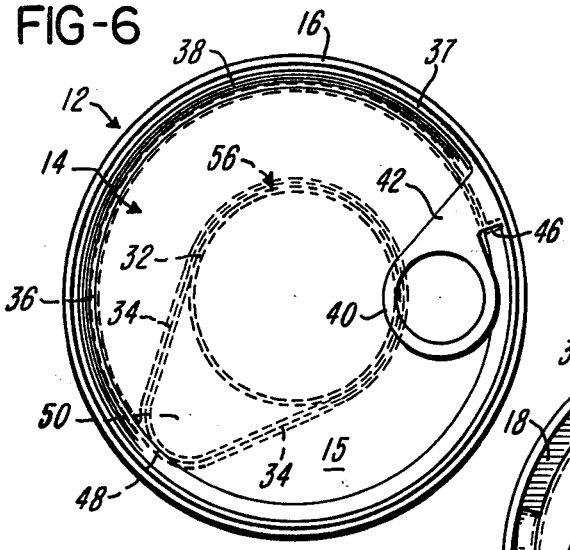
FIG-7
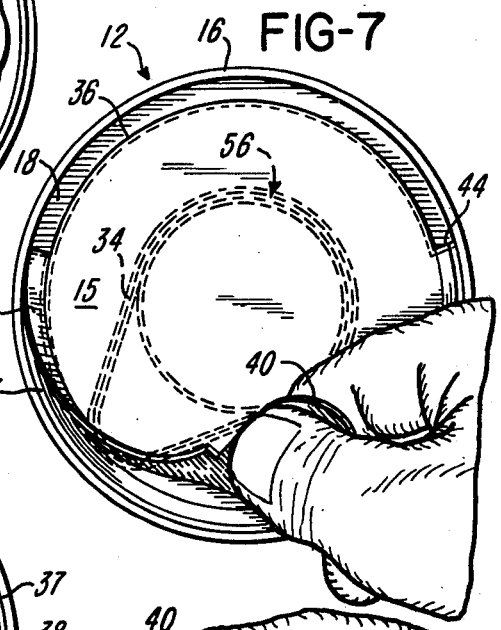
FIG-8
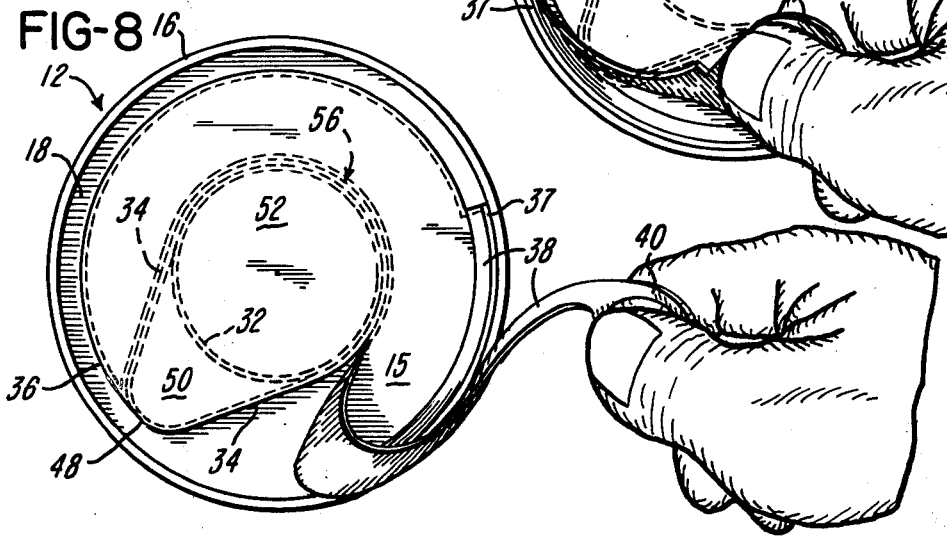
FIG-9
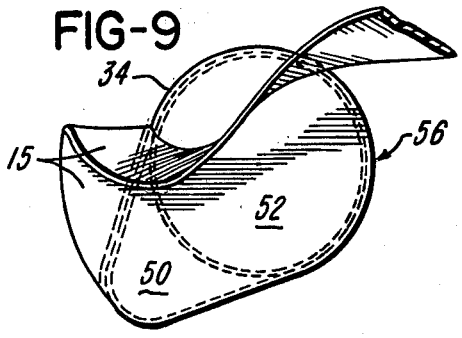
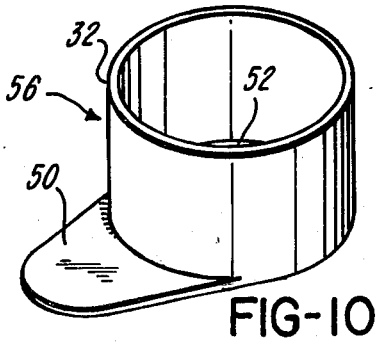
FIG-10

CONTAINER HAVING CLOSURE PANEL INCLUDING INTEGRALLY FORMED SCOOP RUPTURABLE THEREFROM

This application is a continuation of application Ser. No. 345,344; now abandoned, filed Feb. 3, 1982 which was a continuation of application Ser. No. 205,458 filed Nov. 10, 1980, now abandoned.

BRIEF SUMMARY OF THE INVENTION

A container formed in accordance with the present invention comprises a molded container blank having a tubular container wall, said wall closed at one end thereof by a molded closure panel which is one-piece with the container wall and the container wall adapted to be closed at the opposite end thereof by a metal base which, after filling of such container with stuff to be stored therein, is joined with a double seam to the open end of the container wall. The container wall is provided with an integrally formed chime which surrounds the closure panel and is joined therewith by an annular rupturable web extending between the container chime and the closure panel and surrounding the latter. Molded as one piece with the closure panel so as to extend inwardly of the container is a cylindrical scoop wall. The closure panel which is flat in the region thereof adjoined by the scoop wall has a sloped surrounding wall at the margin thereof engaged by said annular web, said sloped wall recessing the generally flat panel portion surrounded thereby inwardly of the aforementioned chime.

The scoop wall, along with an interior portion of the closure panel, is removed for use as a scoop upon opening the container by rupture of the aforementioned web for removal of the closure panel. For scoop removal an arcuate scoreline is provided in the closure panel in spaced relation to the aforementioned annular web to allow removal of a tear-out portion of the closure panel which, when progressively torn out, initiates tearing along an endless scoreline surrounding the scoop wall so as to allow extraction from the original closure wall of a scoop including only a part of the original closure wall.

BRIEF DESCRIPTION OF THE DRAWINGS

In the drawings:

FIG. 1 is a perspective view of a container embodying the present invention.

FIG. 2 is a section view, with a portion broken away, illustrating a molded container blank employed in the construction of the container of FIG. 1.

FIG. 3 is a bottom plan view of the container blank of FIG. 2.

FIG. 4 is a section view taken substantially along the line 4—4 of FIG. 1.

FIG. 5 is a fragmentary section view taken substantially along the line 5—5 of FIG. 1.

FIG. 6 is a top plan view of the container illustrated in FIG. 1.

FIGS. 7 and 8 are plan views of the container of FIG. 1 sequentially illustrating the removal of a closure portion from the container.

FIG. 9 is a plan view with a portion broken away illustrating the closure portion fully removed from the container.

FIG. 10 is a perspective view illustrating a scoop derived from the closure portion.

DETAILED DESCRIPTION

Referring to the drawings in greater detail, FIG. 1 illustrates a completed container 12 embodying the present invention. At one end thereof the container 12 is closed by a closure panel 14 surrounded by a rim or chime 16. Integral with and depending from the chime 16 is a surrounding tubular container wall or skirt 30.

As best shown in FIG. 4 the opposite or lower end of the container 12 is closed by a sheet metal base 18 drawn so as to have a pilot 20 sized to fit snugly into the lower portions of the container wall 30. The base 18 has a surrounding shoulder 22 which bears against a relatively thin and flexible flange 24 formed at the lower edge of the container wall 30.

As evident in FIG. 4, the shoulder 22 has been rolled with conventional double-seam rolling equipment so as to have a peripheral wall 26 which wraps about the molded container flange 24 and terminates with a reentrant flange 28 hooked under the molded container flange 24. As is evident in FIG. 1, the double-seam juncture between the molded container flange 24 and the metal base 18 provides an outward projection from the container wall 30 which resembles, in shape, the aforementioned chime 16 but is, of course, located at the opposite end of the container. In order to facilitate labelling it is preferred that the outside surface of the container wall 30 between the chime 16 at the top of the container and the double-seamed juncture at the bottom of the container has its outside surface, at least, in the shape of a right cylinder.

As best appears in FIG. 2, the closure panel 14, the chime 16 and the container wall 30 are molded as a one piece tubular container blank from a suitable plastic material, such as high density polyethylene. In such molding, the flange 24 is formed at the lower end, as it appears in FIG. 2, of the container wall 30. Also molded as one piece with the closure panel 14 is a circular scoop wall 32 which projects into the space surrounded by the container wall 30 from the inside surface of the closure panel 14 and which is of a diameter noticeably smaller than the inside diameter of the container wall 30, with the result that the scoop wall 32, while concentric to the container wall 30, is spaced well within the confines of the container wall 30.

Formed between the closure panel 14 and the container chime 16 is a weakened web 37 which entirely surrounds the closure panel 14 and bridges the closure panel to the container chime 16. The web 37 is concentric to and outwardly spaced from the scoop wall 32. The closure panel 14 can be seen to be generally flat at its central region 15 but to be surrounded by a sloped annular wall 38 engaged at its upper end by the aforementioned web 37. At its lower end, the foot of the sloped wall 38 is provided, as shown in FIG. 2, with an arcuate scoreline 36, which partly surrounds the flat central region of the closure panel 14 and along its surrounding part is concentric with the scoop wall 32.

Immediately adjacent the scoop wall 32 and lying just outside thereof is an endless scoreline 34 which follows the outside curvature of a preponderant portion of the scoop wall 32 but extends outwardly therefrom to form a bight 48 which merges tangentially with one end of the aforementioned scoreline 36.

The scoreline 36 can be seen to proceed in the counterclockwise direction as shown in FIG. 3 from the bight 48 circumferentially about the scoop wall 32 to intersect a radially disposed scoreline 44. The radially disposed scoreline 44 can be seen to proceed from the scoreline 36 outwardly along the sloped wall 38 to merge with the aforementioned web 37, the scoreline 44 defining a relatively thin web 46 (FIGS. 2 and 5) extending along the wall 38 between the scoreline 36 and the web 37. The mold elements which shape the closure panel 14, as well as the surrounding container wall 30 and the chime 16, are so sized that the thickness of the web 37 is substantially the same as the thickness of plastic bridging the scorelines 34 and 36, as well as the scoreline 44, with the consequence that all of these weakened portions can be torn open as will be described with substantially equal effort. All of the scorelines 34, 36 and 44 are indented into the inside face of the closure panel 14.

At the time of molding the one piece plastic part herein described, there is integrally molded as one piece with the sloped wall 38, a pull-out ring 40 joined to the wall 38 by an integrally formed plastic spoke 42. As is evident in FIG. 2, the ring 40 is spaced above the flat central region 15 of the closure panel 14 and the spoke 42 is flared downwardly from the pull-out ring 40 so as to engage the sloped wall 38 along substantially the entire vertical elevation of such wall.

The scoreline 44 is located in approximate alignment with the clockwise edge of the spoke 42 as the spoke appears in FIG. 6. (The scoreline 44 does not appear in FIG. 6 because it is indented in the surface of the closure panel 14 opposite the surface shown in FIG. 6.) Assuming the container 12 to have been filled with stuff to be stored, such as sugar or flour for example, and the metal base 18 to have been double-seamed in engagement with the container flange 24, access to the container is gained as shown in FIGS. 7 and 8 by an operator grasping the pull-out ring 40 and exerting a force which tends to swing the ring 40 leftwardly or counterclockwise about a fulcrumformed along the left or counterclockwise edge of the spoke 42 and the adjoining portion of the sloping wall 38, as the parts are illustrated in FIG. 6. In consequence, the clockwise edge of the spoke 42 is drawn inwardly toward the center of the closure panel 14 whereupon substantial stress is applied along the radial scoreline 44 which therefore ruptures.

Upon rupture of the scoreline 44, the pull-out ring 40 can be lifted and pulled to the left as viewed in FIG. 6, to cause the sloped wall 38 to tear away from the chime 16 by reason of rupture of the web 37 and, simultaneously, to tear away from the central portion 15 of the closure panel 14 by reason of a rupture which proceeds along the scoreline 36. As apparent in FIG. 7, the wall 38 tears uniformly from between the concentric and parallel weakenings 36 and 37.

As evident in FIG. 8, the described uniform tearing of the sloped wall 38 follows the weakenings 36 and 37 in the counterclockwise direction appearing in FIG. 8 to a point where the arcuate scoreline 36 tangentially merges into the bight 48, whereupon continued tension created by pulling along the now removed portion of the wall 38 causes the plastic material of the closure panel 14 to tear along the endless scoreline 34, as well as along the weakening 37, such that the width of the plastic material being removed from the closure panel 14 increases substantially. This transition from rupture along the arcuate scoreline 36 to rupture along the endless scoreline 34 occurs because the scoreline 36 terminates at the bight 48 where merged with the scoreline 34.

As evident in FIG. 9, the continued maintenance of tension by pulling along the length of the plastic material now being removed causes the scoreline 34 to rupture progressively around the scoop wall 32 while, at the same time, rupture along the weakening 37 continues until all portions originally constituting the closure panel 14 have been torn away from the chime 16.

It is to be appreciated that FIGS. 8 and 9 are idealized. Thus, in FIG. 8, the scoop defined by the scoop wall 32 and those portions of panel 14 bounded by the endless scoreline 34 is unsupported with respect to the container chime 16 except by approximately 100° in peripheral length of the web 37 remaining to be severed. Depending upon the direction in which the operator is exerting forces on the pull-out ring 40, it can be appreciated that the scoop wall 32 will now be tending to move with the unsevered portions of the closure panel 14 and thus continued tearing along the scoreline 34 will tend to cease. Should the operator now place a finger at the center of the original closure panel 14, tearing along the scoreline 34 will continue because the described finger pressure will perpetuate the rupturing which is occurring along the scoreline 34. Regardless of the procedures employed by the operator, the closure panel 14 becomes entirely removed from the chime 16 and this will ordinarily occur before tearing along the scoreline 34 is complete, thus to leave in the operator's hand which has been engaging the pull-out ring 40 the entirety of the original closure panel 14 with an incomplete tear having occurred along the scoreline 34. The operator now needs only to grab the scoop wall 32 with his free hand and, by exertion of tension between the scoop wall 32 and the pull-out ring 40, complete the tear along the endless scoreline 34 so as to free from the original closure panel 14 the scoop 56 appearing in FIG. 10.

The scoop 56 of this invention comprises the tubular scoop wall 32, which was originally dependent from the inside surface of the panel 14, and a circular scoop base plate 52, originally a part of the central panel region 15, that closes one end of the tubular wall 32, the other end of wall 32 being unobstructed so that the tubular wall 32 and base plate 52 form an open cup. The scoop 56 further comprises a handle 50 which is a plate-like member integral and coplanar with the scoop base plate 52. The handle 50 is formed of that region of the original closure panel 14 bounded by the bight 48 and having side edges that merge and extend tangentially to the scoop base plate 52. Thus the scoop 56 is designed uniquely to enable it to be molded integrally with, and later severed along a scoreline from, a closure panel its handle coplanar with the cup base rather than the usual scoop construction wherein the handle normally extends from the open rim of the cup.

Although the preferred embodiment of this invention has been described, it will be understood that various changes may be made within the scope of the appended claims.

I claim:

1. A container construction comprising a generally tubular wall, a panel disposed to close one end of said tubular wall, a scoop wall integral with said panel and projecting into the space surrounded by said tubular wall, rupturable web means one piece with said panel, said web means joined to said tubular wall in surrounding relation to said panel, said panel having an endless first rupturable scoreline surrounding said scoop wall, said first scoreline including a bight portion which is spaced outwardly from said scoop wall, said panel having an arcuate second rupturable scoreline merging with said bight portion, said panel having a third rupturable scoreline extending from said second scoreline to said web means, and pull-out means integrally affixed to said panel adjacent said third scoreline.

2. The construction of claim 1 wherein said tubular wall includes a chime at said one end and said web is one piece with said chime.

3. The construction of claim 1 wherein said second scoreline terminates at said bight.

4. The construction of claim 1 wherein said tubular wall is a cylindrical wall and said arcuate second scoreline extends circularly about the axis of said tubular wall between said bight and said third scoreline.

5. The construction of claim 4 wherein said third scoreline extends radially with respect to the axis of said tubular wall from said arcuate scoreline to said web.

6. The construction of claim 1 wherein said panel comprises an annular sloped wall at the margin thereof joined by said web to said tubular wall.

7. The construction of claim 1 wherein said first and second scorelines are indented in the face of said panel from which said scoop wall projects.

8. A combination container and scoop comprising a container member having a tubular wall, a panel disposed to close one end of said tubular wall, a scoop wall integral with said panel and projecting from one face thereof into the space surrounded by said tubular wall, rupturable web means one piece with said panel, said web means joined to said tubular wall in surrounding relation to said panel, said panel having an endless first rupturable scoreline surrounding said scoop wall, said first scoreline including a portion which is spaced from said scoop wall defining edge portions of a scoop handle portion in said panel, said panel having an arcuate second rupturable scoreline merging with said spaced portion, said panel having a third rupturable scoreline extending from said second scoreline to said web means, pull-out means integrally affixed to said panel and protruding from the face of said panel opposite the face of said panel from which said scoop wall projects, and means closing the opposite end of said tubular wall.

9. In a container construction including a tubular wall and a closure panel severably connected to said wall, the improvement comprising a scoop integral with said panel, said scoop including a scoop wall projecting from said panel into said tubular wall, a scoop handle, and a scoop base, said scoop handle and said scoop base comprising parts of said panel, and an endless scoreline formed in said panel bounding said scoop handle and said scoop base.

10. The construction of claim 9 wherein said panel includes a second scoreline along which portions of said panel are severed from one another when said panel is removed from said tubular wall, said second scoreline merging with said endless scoreline.

* * * * *